US005375721A

United States Patent [19]

LaVigne

[11] Patent Number: 5,375,721

[45] Date of Patent: Dec. 27, 1994

[54] APPARATUS FOR DRY PLACER MINING

[76] Inventor: Gordon LaVigne, P.O. Box 538, Colville, Wash. 99114

[21] Appl. No.: 872,963

[22] Filed: Apr. 23, 1992

[51] Int. Cl.[5] ..... B03G 7/00

[52] U.S. Cl. ..... 209/131; 209/420

[58] Field of Search ..... 209/470, 471, 472, 131, 209/485, 486, 822, 820; 198/698, 848

[56] References Cited

U.S. PATENT DOCUMENTS

| | | | |
|---|---|---|---|
| 344,720 | 6/1886 | Carpenter | 209/20 |
| 529,340 | 11/1894 | Watson et al. | 209/470 |
| 714,257 | 11/1902 | Sutton et al. | 209/470 |
| 719,397 | 1/1903 | Waugh | 209/131 |
| 830,538 | 9/1906 | Stebbins | 209/12 |
| 1,083,172 | 12/1913 | Winnie et al. | 209/131 |
| 2,116,613 | 5/1938 | Bedford | 209/131 |
| 2,144,671 | 1/1939 | Adams | 209/470 |
| 2,299,298 | 10/1942 | Bignell | 209/470 |
| 2,689,648 | 9/1954 | Maestas | 209/131 |
| 2,769,531 | 11/1956 | Guba | 198/195 |
| 2,864,501 | 12/1958 | Bolander | 209/470 |
| 3,096,277 | 7/1963 | Maestas | 209/20 |
| 3,233,722 | 2/1966 | Jorgensen | 198/196 |
| 3,773,174 | 11/1973 | Stimpel | 209/131 |
| 3,799,334 | 3/1974 | Collins | 209/11 |
| 4,451,357 | 5/1984 | LaVigne | 209/131 |

*Primary Examiner*—Robert P. Olszewski
*Assistant Examiner*—Kenneth Noland
*Attorney, Agent, or Firm*—Hughes & Multer

[57] ABSTRACT

A dry placer mining machine and a belt assembly for use therewith. The machine concentrates metallic constituents from a gravel mix by fluidizing the mix with air which passes upwardly through the belt assembly, and moving the fluidized mix over the belt and applying an electrostatic charge thereto. The belt assembly is made up of a composite fabric belt member and a plurality of riffle members which extend transversely across this. The composite fabric belt member is constructed of non-conductive materials so as to minimize dissipation of the electrostatic charge, and this is made up of a finely woven cloth top layer, a reticulated foam middle layer, and a coarse mesh lower layer. The riffle members, in turn, are provided with insulation for preventing the electrostatic charge from being conducted away from the fabric belt member. The belt assembly is driven over the open upper end of a plenum chamber, and air pressure is supplied to this through a blower and ducting. The internal surfaces of these components are coated with an insulating material which enhances the build-up of electrostatic charge on the airflow.

42 Claims, 5 Drawing Sheets

APPARATUS FOR DRY PLACER MINING

BACKGROUND OF THE INVENTION

1. Field of the Invention

The present invention relates generally to apparatus for dry placer mining, and, more particularly, to such apparatus for concentrating recoverable metallic products from gravel particulate wherein the separatory effects are the consequence of fluidization of the gravel and electrostatic retention of the metallic constituent on a moving belt.

2. Background Art

Dry placer mining, particularly for mining gold and silver from gravel deposits, has been known for many years. In an earlier application, which issued May 29, 1984 as U.S. Pat. No. 4,451,357 (hereby incorporated in its entirety by reference), applicant disclosed a machine which has proven highly successful for such mining operations. This is a compact, durable, and highly efficient device which concentrates metallic products from gravel particulate by employing a fluidizing air stream and an endless belt which is electrostatically charged by the air stream.

Inasmuch as the overall configuration of this earlier machine is somewhat similar to that of the improved machine of the present invention (and the improvements of the present invention are in some respects relative to the former), a general overview of these systems will be provided here. Accordingly, turning to FIG. 1, this shows a dry placer mining machine, designated generally as 10, which comprises generally a frame 12 which supports and guides an endless separation belt 14 about a closed, generally trapezoidal path surrounding a fluidization means in the form of an air box or plenum chamber, this being designated generally as 16. The separation belt 14 is caused to traverse the closed path by means of a drive system, designated generally as 18. As the belt moves about its path, ore or a particulate gravel mix containing metallic constituents is charged to the upper face of machine 10 along an upwardly inclined segment of the trapezoidal path, designated 20 in FIG. 1, while fluidization gas (most conveniently, air drawn from the surrounding atmosphere) is passed upwardly from the open mouth of plenum chamber 16 through the separation belt 14. As the belt moves upwardly along the inclined path, as represented by the arrow in FIG. 1, the gravel and sand components of the charge are fluidized by the air passing through the belt. During this fluidization, as a consequence of the structure of the belt 14 and its relationship to the plenum chamber 16, an electrostatic charge is developed proximate the separation belt 14. As a result of the combination of the fluidization of the gravel and the electrostatic charge which is developed on or proximate the belt, the metallic constituents are retained on separation belt 14 while the gravel is fluidized and flows downwardly across the inclined slope of the belt. The retained product is thereby enriched or concentrated in the relative proportion of metallic constituents vis-a-vis the original gravel. The concentrate, which includes heavy or dark sands, may then receive further refining treatment.

Since machine 10, at least in its smaller embodiments, is intended to be portable, the frame 12 is comprised of a base plate 22 which provides a solid foundation, and an upper frame structure designated generally as 24, this being pivotally mounted on the base plate 22. The plate

22 includes a pair of stanchion members 26, and these support the upper frame 24 about pivot pins 28 so that the frame 24 and associated portions of machine 10 may pivot from a transportation configuration, where the face 20 is in a generally horizontal orientation, to an inclined operational configuration such as that shown in FIG. 1. Any convenient means for pivoting the frame on the pivot pins may be employed; FIG. 1 shows a pair of hydraulic cylinders 30 which are conveniently employed to serve this purpose. Whatever means are used to apply the pivoting force, it is desirable that the same be capable of providing an adjustable angle of inclination to the upper face 20 of the belt, since this angle is an important factor in establishing the residence time of the gravel on the belt during the separation process.

The construction of belt 14 is of manifest importance to the efficient separation of the metallic constituents of the gravel charge. In the machine which was disclosed by the above-referenced earlier patent, the belt comprised three components, namely a woven metal mesh belt, a plurality of round riffle members, and a fabric member. The woven mesh belt was a steel mesh web which made up a series of upstanding loop elements, through which the round riffle members were inserted so as to extend transversely with respect to the upwardly inclined path of the belt, generally as shown in FIG. 1, so that these defined a series of transverse collection zones. The riffle members were relatively small diameter (i.e., $\frac{5}{8}$ inch) steel rods, positioned within the mesh-to yield collection zones about $3\frac{1}{2}$ inches wide. The fabric member (which was positioned beneath the riffle members) comprised an intermediate layer of an air pervious polyester foam, sandwiched between lower and upper fabric layers. The upper fabric layer was made of a relatively fine woven cotton/polyester blend broadcloth, while the lower layer was made from a synthetic fiber fabric or batting having a fairly open weave, such as a coarse woven polyester batting of fibers such as those sold under the name Orlon TM.

As noted at the outset, this previous machine has for the most part proven highly successful in the field. Nevertheless, its belt assembly (constructed in the manner described above) has exhibited a number of inefficiencies. Perhaps foremost amongst these has been the tendency for the electrostatic charge to dissipate from the belt assembly, thus reducing the ability of the belt to retain sufficient charge to efficiently separate the constituents of the gravel charge, and so this has led to the need to provide an auxiliary electrostatic charge generator. It has been discovered that this tendency to dissipate the electrostatic charge is linked to the use of various uninsulated metallic components in the construction of the belt, the steel rods forming the riffle members and the steel mesh web are excellent conductors which tend to quickly dissipate the charge, and the "flights" which form the upstanding borders of the belt assembly have also been constructed out of steel. Furthermore, it was found that the cotton/polyester blend broadcloth material which was used to form the uppermost layer of the fabric member of the belt, while performing admirably under very dry conditions, also tended to cause dissipation of the charge when conditions became damp, this apparently occurring due to absorption of water by the cotton component of the material.

Another inefficiency which was observed with the belt having the construction described above relates to the relatively small diameter of the riffle members which have previously been employed. In operation, it was noted that as the metallic constituents were collected on the belt, these tended to accumulate in "pockets" which were formed at the lower edge of each collection zone where the underlying fabric member met the riffle; in practice it was found that these pockets were insufficient in size and so tended to quickly overfill and lose their ability to retain the metallic particles.

Other difficulties which were encountered with the belt having the construction described above stemmed from the arrangement of the upstanding plates or "flights" which formed the borders of the belt. By way of illustration, the corresponding flights in the machine of the present invention are designated generally by reference numeral 32 in. FIG. 1. As was noted above, in the earlier machine these flights consisted of a series of thin metal plates, which aggravated the dissipation of the electrostatic charge from the belt. Another problem which was encountered with the metal flights was that these presented a serious safety hazard, inasmuch as gaps open and close between the adjacent flights where these pass over the sprockets at the ends of the inclined run of the belt, and an operator's hand or other body part might accidentally be received in these gaps and be severely cut.

It was also found to be difficult to form an effective seal to prevent the escape of air from the plenum chamber when using the belt having the prior construction. In an attempt to overcome this problem, an additional elongate sealing member (typically round or half-round in cross-section) was installed along the edge of the plenum, and then this was permanently compressed against the edge of the belt so as to form a seal; not only has this approach proven marginally effective in terms of forming the desired airtight seal, but the additional drag and friction which was generated due to the need to keep the sealing member partially compressed hindered the smooth operation of the machine, and in severe cases could cause tearing of the belt.

Other inefficiencies which were encountered with the previously-existing type of machine included the tendency of excessive undesirable mineral dust and other non-metallic particulate matter to accumulate on the belt, whether due to the electrostatic charge or simple adhesion, so that this was collected with the metallic constituents and so diluted the concentration of the recovered material. Also, in many applications it was found necessary to install a supplemental electrostatic charge generator in the plenum chamber inorderto augment the buildup of the electrostatic charge which occurs as the air passes through the belt material, reducing the overall economy of the operation; as was noted above, the need for this auxiliary generator was increased by the tendency of the belt to dissipate its electrostatic charge.

Accordingly, there exists a need for a dry placer mining machine of the type described above, wherein the construction of the moving belt of the machine reduces or eliminates dissipation of the electrostatic charge which is imparted thereto.

Furthermore, there exists a need for a machine having such a belt in which increased collection areas are formed where the riffle members and the fabric member of the belt meet at the lower edges of the collection zones.

Furthermore, there exists a need for a machine having such a belt in which the flights at the borders of the belt have a construction which reduces or eliminates the possibility of personnel being cut thereby.

Furthermore, there exists a need for a machine having such a belt in which the belt forms an effective seal to prevent escape of air along the edges of the plenum chamber without generating excessive friction and drag between the belt and chamber.

Furthermore, there exists a need for such a machine having means for dislodging and removing excess accumulations of undesirable mineral dust and other particulate matter from the surface of the belt prior to the concentrated metallic constituents being collected therefrom.

Still further, there exists a need for such a machine which is constructed so as to eliminate the necessity of using an auxiliary electrostatic charge generator to provide sufficient electrostatic charge on the moving belt assembly.

SUMMARY OF THE INVENTION

The present invention has solved the problems cited above, and comprises generally an improved belt assembly for use in a dry placer mining machine which concentrates metallic constituents from a gravel mix by fluidizing the mix with a gas and separating the metallic constituents from the mix by moving the fluidized mix over the belt assembly and applying an electrostatic charge thereto. The belt assembly comprises broadly a composite fabric belt member which is configured so that the electrostatic charge is established on the belt member as the fluidizing gas passes therethrough, this fabric belt member being constructed substantially entirely of non-conductive materials so as to minimize dissipation of the electrostatic charge, with a plurality of riffle members extending transversely across the fabric belt member in spaced, generally parallel relationships so as to define a series of collection zones, each of these riffle members being attached to the fabric belt member and comprising insulating means for preventing dissipation of the electrostatic charge due to this charge being conducted away from the fabric belt member through the riffle members.

The composite fabric belt member may comprise an upper layer of relatively finely woven cloth, this being non-conductive in character and resistant to absorption of moisture so that it retains its non-conductive character under damp operating conditions, a middle layer of air pervious foam, this also being non-conductive in character and further having pores sized generally larger than the openings in the finely woven cloth, and a lower layer of relatively coarsely woven cloth, this once again being non-conductive in character and having openings sized generally larger than the pores of the middle layer of foam, whereby the composite fabric belt member presents a gradient from bottom to top, corresponding to the direction in which the fluidization gas passes therethrough.

The relatively finely woven cloth of the upper layer may be 100% polyester cloth, such as a broadcloth having a weave of about 200 threads per inch. The coarsely woven cloth of the lower layer may preferably be more resistant to stretching than the middle and upper layers, so that this forms a backing which imparts strength to the belt assembly during operation, and this may be formed from a coarsely woven vinyl coated polyester mesh. The middle layer of foam between these upper and lower layers, in turn, may preferably be a reticulated foam, such as polyester foam, in which the pores are of substantially uniform size so that the flow of the fluidization gas is evenly distributed through the fabric belt member by the foam layer.

The insulating means of each riffle member may comprise a sleeve of insulating material which surrounds the riffle member, and this may be a sleeve of polyurethane tubing which surrounds a metallic rod which forms a core member of the riffle member. A metallic sleeve member may be positioned concentrically intermediate the core member and the outer sleeve member for providing the riffle member with additional strength and diameter, and an inner sleeve member of insulating material may be positioned concentrically intermediate the metallic sleeve and the core member so as to provide an additional insulating layer between these.

The belt assembly may further comprise a plurality of flights positioned intermediate the edge of the fabric belt member and a drive chain which is mounted to the ends of the riffle members, so that these flights form an upstanding border along the edge of the belt member. The flights are formed of a flexible, resilient material so as to avoid posing a hazard to personnel where gaps between adjacent flights open and close during operation of the machine. The flights each have first and second cooperating bores which are configured to receive outer ends of adjacent core rods of the riffle members, and preferably, at least one of the cooperative bores is elongated so as to permit a predetermined amount of movement of the adjacent riffle members toward and away from one another during operation of the machine without requiring deformation of the flights.

A dry placer mining machine is also provided for concentrating metallic constituents from a gravel mix by fluidizing the mix with a gas and separating the metallic constituents therefrom by moving the fluidized mix over a belt and applying an electrostatic charge thereto. The machine comprises a frame for supporting and guiding an endless separation belt along a closed path having an upwardly inclined segment for receiving a gravel mix containing a low concentration of metallic constituents. The endless separation belt assembly comprises a composite fabric belt member which is configured so that the electrostatic charge is established thereon as a fluidizing gas passes therethrough, this fabric belt member being constructed substantially entirely of non-conductive material so as to minimize dissipation of the electrostatic charge. A plurality of riffle members extend transversely across the fabric belt member in spaced, generally parallel relationship so as to define a series of collection zones, each riffle member being attached to the fabric belt member and comprising insulating means for preventing dissipation of the electrostatic charge due to this being conducted away from the fabric belt member through the riffle members. Fluidizing means are provided for passing the fluidizing gas upwardly through the fabric belt member substantially uniformly along and about the upwardly inclined segment of the belt so as to fluidize the gravel mix and establish the electrostatic charge on the belt assembly, and drive means are provided for driving the belt assembly along the closed path so that the fluidized gravel mix moves over the belt assembly and the electrostatic charge effectuates a substantial separation of the metallic constituents from the gravel mix and retention of the metallic constituents proximate the riffle members, whereby the metallic constituents are concentrated for collection.

The machine may further comprise means for removing accumulations of non-metallic particulates from the belt assembly prior to collection of the concentrated metallic constituents, and this means may comprise nozzle means for directing a flow of compressed gas towards the belt proximate an upper end of the inclined segment so as to dislodge the accumulations therefrom, and means for supplying the compressed gas to the nozzle means. The nozzle means may comprise a plurality of nozzles spaced across the width of the belt assembly proximate the upper end of the inclined segment, and these nozzles may be in communication with a manifold tube which extends across the width of the belt. The compressed gas may be supplied by means for connecting the manifold tube in fluid communication with the same means which passes fluidizing gas through the separation belt assembly.

The interior portions of the means for passing fluidizing gas through the belt assembly which are subject to contact with the fluidizing gas may be coated with an insulating material which is configured to build up an electrostatic charge on the gas, so as to supplement the electrostatic charge which is established on the belt assembly. This insulating material may comprise a polyurethane coating.

Other features and advantages, and a full appreciation of the structure and utility of the invention, will be gained upon an examination of the detailed description of the invention, taken in conjunction with the accompanying drawings.

DETAILED DESCRIPTION a. Overview

The present invention relates generally to apparatus for dry placer mining and, more specifically, to such apparatus wherein separation of valuable, metallic products such as gold or silver from gravel particulate containing the same is affectuated under the combined influences of fluidization of the gravel and electrostatic retention of the metallic product on a traveling separation belt. Accordingly, the invention will now be described with reference to certain preferred embodiments within the aforementioned context, although those skilled in the art will fully appreciate that Such a description is meant to be exemplary only and should not be deemed limitative. For example, it may be desirable in some applications to utilize such an apparatus to segregate undesirable metallic constituents (e.g., iron) from the gravel or other mineral particulate material, such as in the preparation of the gravel for use in cement mixes.

Figure 1:
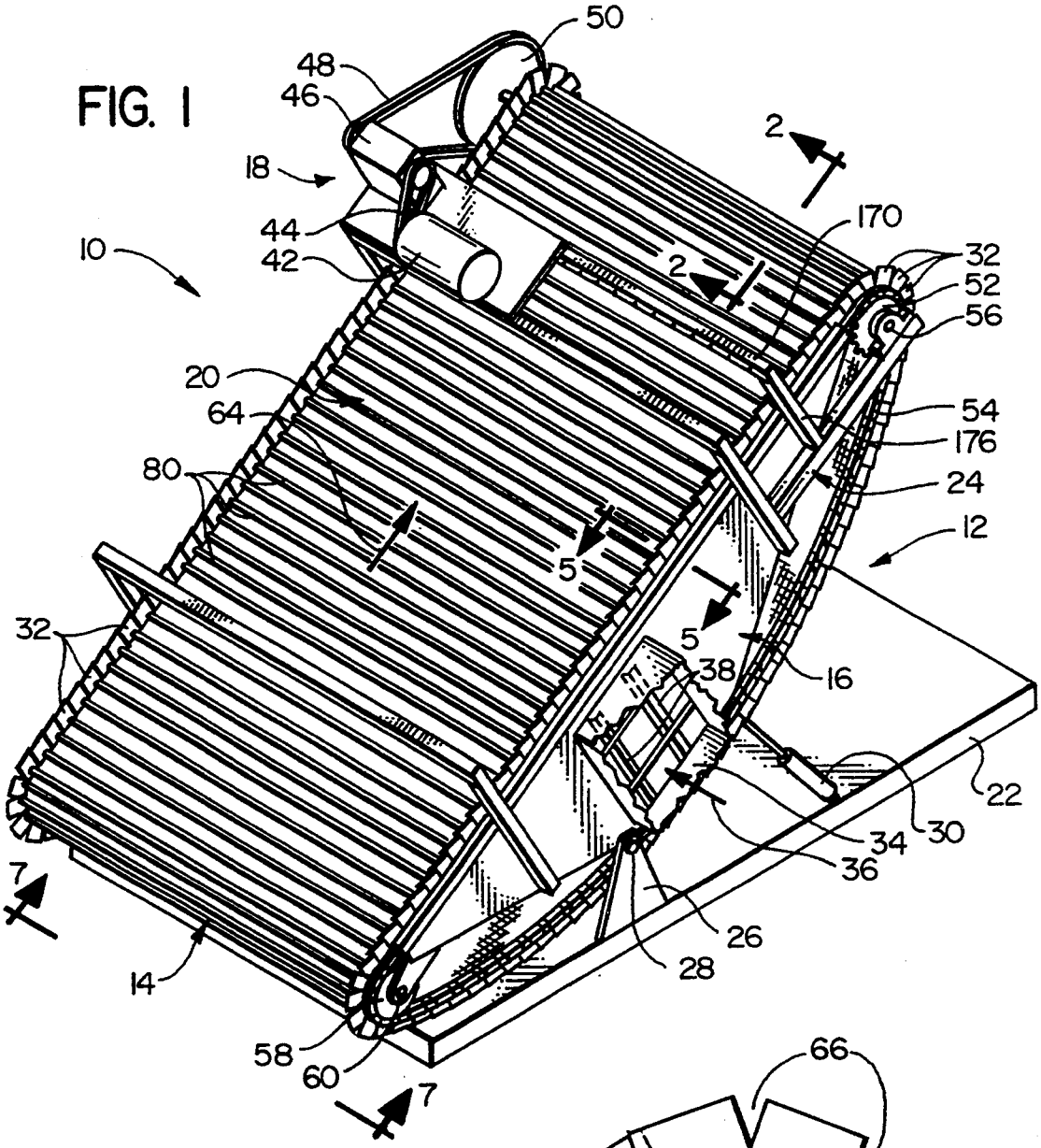
FIG. 1 is an isometric view, with parts broken away, of a dry placer mining machine which incorporates the present invention.

Turning now to the drawings, in all of which like parts are identified by like reference numerals, a dry placer mining apparatus incorporating the present invention is shown in FIG. 1. As noted above, this comprises generally a frame 12 made up of a base plate 22 and a pivotable upper frame 24, the belt assembly 14 being driven about the generally trapezoidal, closed path defined by the upper frame by a drive system 18.

As noted above, the upwardly inclined segment 20 of belt 14 extends over the air plenum chamber 16. Air, or other suitable fluidizing gas, is supplied to the interior of plenum chamber 16 through a duct 34 by a fan assembly (not shown in FIG. 1, but shown in FIG. 7) in the direction indicated generally by arrow 36. Both the duct and the interior of the plenum chamber include a series of baffle plates or deflectors 38, some of which are shown in FIG. 1, which serve to distribute the flow of fluidizing air uniformly throughout the plenum so that the air which is directed upwardly through the belt is substantially uniform along and across the inclined segment 20.

Figure 2:
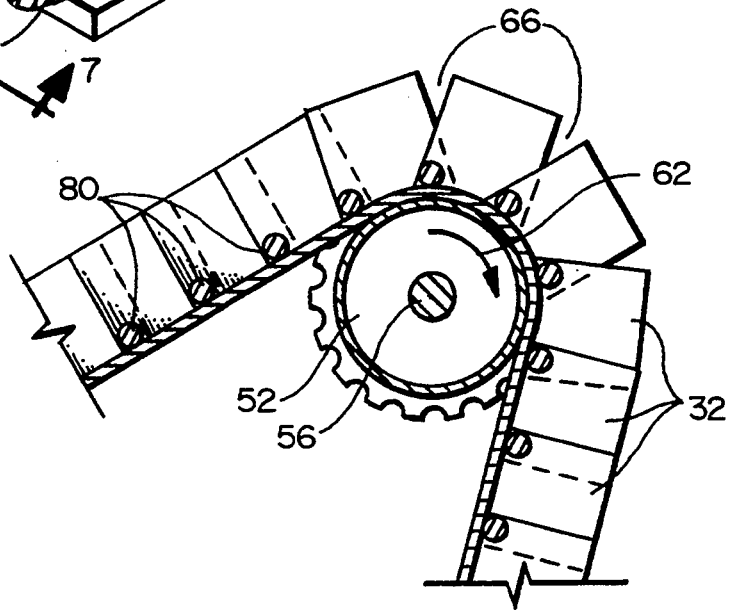
FIG. 2 is an enlarged, fragmentary sectional view taken along line 2—2 of FIG. 1, showing the manner in which the gaps between adjacent flights at the edge of the belt assembly open and close as these pass over the sprockets at the upper end of the belt.

As noted above, belt 14 is moved about its closed path by drive system 18. Preferably, this comprises a motor 42 (such as a suitable electric motor) which operates through a first belt 44, reduction gear 46, and second belt 48, to drive a pulley 50 at the upper end of the inclined upper frame 24. Pulley 50 is connected via an axle 56 to a pair of drive sprockets 52 (one only shown in FIG. 1), each of which engages a drive chain 54 which is mounted along the edge of the belt assembly. Similarly, a pair of idler sprockets 58 engage drive chains 54 at the lower end of inclined segment 20, these also being interconnected by a second axle 60 which is pivotally mounted to frame 24. As sprockets 52 rotate in the direction indicated by arrow 62 in FIG. 2, they draw the belt assembly 14 up the inclined segment 20, in the direction indicated by arrow 64 in FIG. 1. As the belt reaches the upper end of the inclined segment, and rounds the "corner" at the drive sprockets 52 (see FIG. 2) to begin the return run of the closed loop, gaps 66 open and close between the upper ends of the overlapped row of flights 32 which make up the segmented border of the belt assembly. It is these gaps which have previously presented a personnel hazard, due to the possibility of hands and so forth being accidentally received in these gaps and becoming cut, this problem having been overcome in the present invention by the adoption of flights which are constructed of a suitable semi-rigid, yet resilient material, as will be described below.

Figure 3:
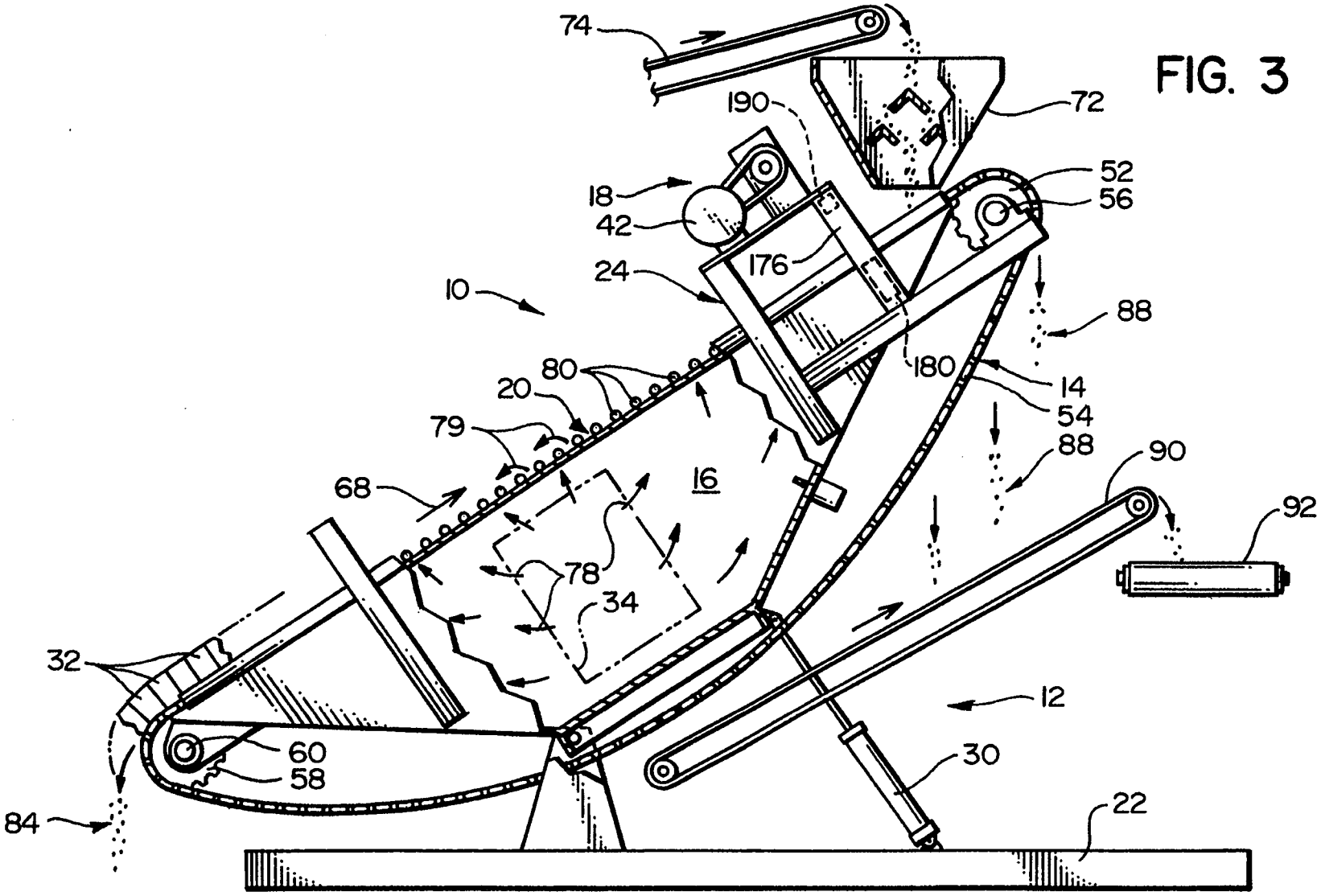
FIG. 3 is a sectional, side elevational view of the machine of FIG. 1, illustrating the operation of the machine to collect desired metallic constituents from gravel or other particulate matter which is charged onto the belt at the upper end of its upper run.

FIG. 3 illustrates the overall operation of machine 10. With the belt moving in the direction indicated by arrow 68 in FIG. 3, the screened gravel, preferably having an average size of less than ¼ inch, is conveyed to a hopper 72 by suitable transport means, such as a conveyor belt 74. The hopper distributes the gravel mix uniformly across the belt 14 near the upper end of the inclined segment 20. Fan 76 (see FIG. 7) simultaneously provides fluidization air to plenum chamber 16; this air flows through the chamber generally in the directions indicated by arrows 78, and then through belt 14 in an upward direction. As the belt moves, the gravel charge thereon is fluidized by means of the upwardly directed pressurized air flowing through the belt, which classifies the lighter components from the more dense "dark" sands and metallic constituents. The fluidized portion of the gravel falls by gravity just above the surface of the belt 14, generally in the directions indicated by arrows 79, and as is shown diagrammatically in FIG. 6. As the gravel tumbles over the riffles, the air causes a turbulent flow of gravel which follows a somewhat elliptical or oval path. All this activity, with air passing through the composite fabric which makes up the fabric member of belt 14, creates an electrostatic potential or charge imbalance proximate the belt 14. This electrostatic potential will have little or no effect on the gravel, but will result in an attraction and retention of the metallic constituents proximate the belt 14. In practice, it is found that the metallic constituents tend to congregate at the upstream side of the riffle members 80 and, more particularly, on the underside of the curved surface thereof such as is indicated at 82 in FIG., 6, which, by virtue of the curved profile and underlying fabric member, provides a closed collection space or "pocket" which traps the retained material. As the belt 14 continues its upward travel, with the separated or concentrated metallic constituents retained thereon along with dark sands, the gravel which has had these metallic constituents removed therefrom falls from the bottom of the device as tailings 84. When the belt reaches the uppermost part of the inclined segment 20 and begins its downward decent on the return side, the metallic constituents and dense particulate will tend to be dislodged, and will fall, as indicated generally at 88 so as to be deposited on a second moving conveyor belt 90, which discharges these concentrates to a pan or container, or possibly to yet another conveyor belt 92 which carries the concentrates away to such a container. Depending on the ambient conditions, it sometimes occurs that the residual electrostatic potential on the belt 14 retains the metallic particles even during this downward decent, so that not all of the particles are dislodged for collection. Accordingly, it is generally advantageous to include a "bump bar" or small magnetic vibrator at or near the point where the belt first leaves the drive sprocket array region to bump or vibrate the belt and assist in the dislodgement of the particulate.

b. Fabric Member of Belt Assembly

Figure 4:
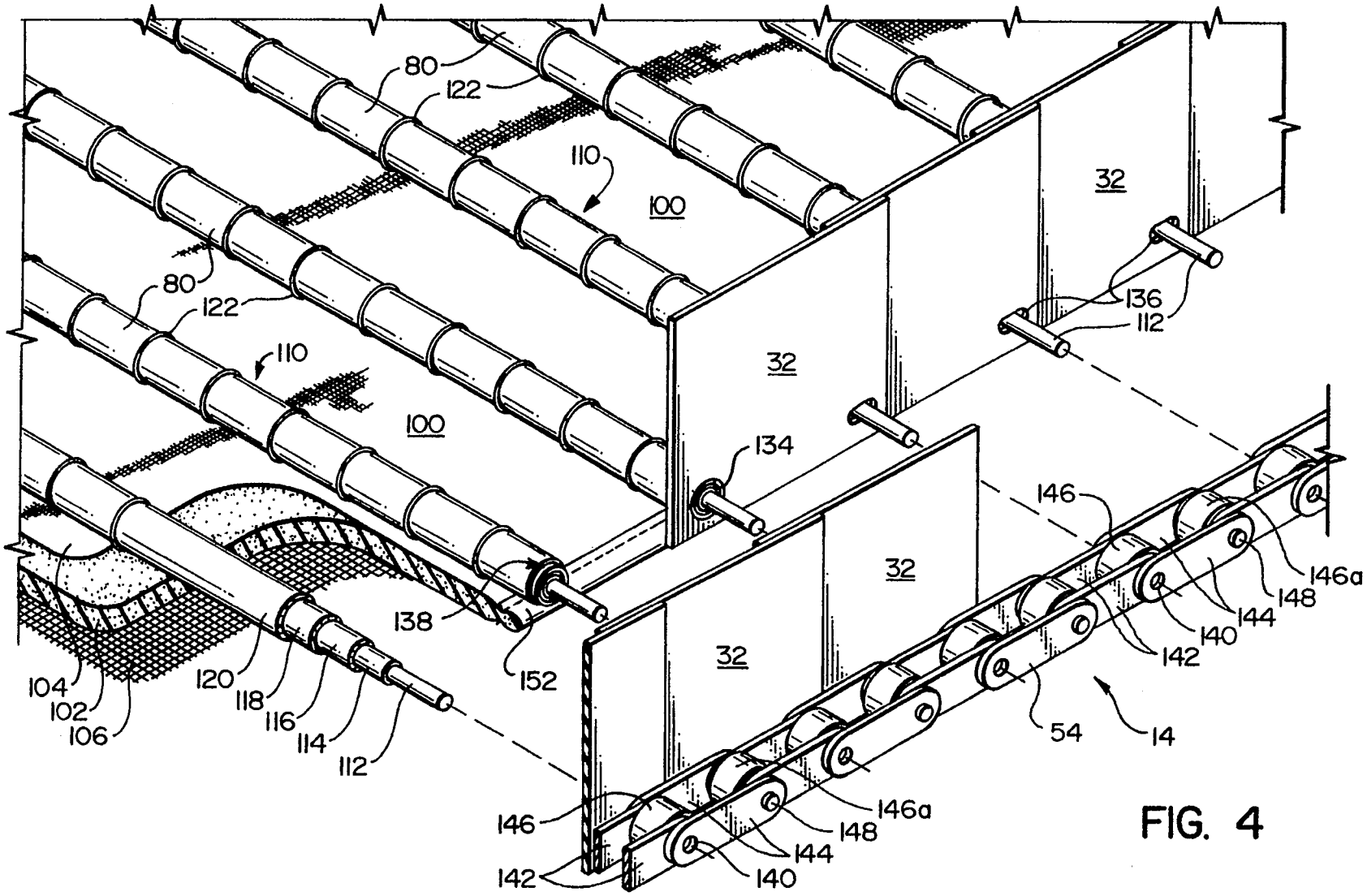
FIG. 4 is an isometric view of an edge portion of the belt assembly of the machine of FIG. 1, with this being partially exploded and cut away to illustrate the construction of (a) the fabric member of the belt assembly, (b) the rod-like riffle members of the assembly, and (c) the upstanding flights at the edge of the assembly.

As noted above, the construction of the separatory belt is important to the efficiency of the separation of the metallic constituents from the gravel charge; turning now to FIG. 4, this shows a portion of this belt assembly which, in accordance with the present invention, incorporates several features which significantly improve its performance. First amongst these is the construction of the fabric member 100, which provides both improved electrostatic charge retention characteristics and greater durability and resistance to stretch in service. This fabric member resembles the corresponding element which was employed in the earlier constructions of belt, in that it is made up of an intermediate layer of air pervious foam sandwiched between upper and lower layers of fabric. In accordance with the present invention, however, this intermediate foam layer 102 is preferably made from a reticulated foam material (i.e., having pores of uniform size), most preferably polyester foam, this having been found to provide much more even distribution of the air which passes through the fabric member; a reticulated polyester foam having a porosity of about 60 ppi has been found eminently suitable for this application.

The upper layer 104, in turn, is preferably made from a 100% polyester cloth having a relatively fine weave, such as polyester broadcloth having a weave of 200 threads per inch; by avoiding the use of cotton in this fabric layer, the charge dissipation problems which were exhibited by the earlier cotton/polyester blend material due to water absorption under damp conditions have been eliminated. Finally, the lower layer 106 is preferably made of an open weave, heavy-duty vinyl coated polyester fabric, such as that sold under the name Phifertex TM by Philet Wire Products, Inc. of Tuscaloosa, Ala., this exemplary material being constructed of a heavy, 25 mil polyester yarn using a 17×12 mesh. This fabric been found to exhibit high breaking strength and excellent resistance to stretch during use, and thus forms a high-strength backing for the fabric member; this has made it possible to eliminate the steel webbing which was needed in previous constructions of the belt assembly. Furthermore, due to its construction of vinyl and polyester, this lower layer provides additional protection against dissipation of the electrostatic charge on the belt assembly.

Thus constructed, the composite fabric member 100 presents a gradient in the pore size or dimensions of the air passageways from bottom to top, corresponding to the direction which the fluidization air flows through the belt 14. This construction has been determined empirically to provide very good airflow characteristics while maximizing the electrostatic charge which is a principle factor in the efficiency of separation of the metallic constituents from the gravel charge. When subjected to a fluidization airflow passing upwardly through the fabric member (a variable static pressure averaging about 6.2 psig of dry air has been found suitable), a turbulent airflow within the mix is established, imparting a charge which attracts the metallic constituents to the belt and riffles. The composite construction which is used in this fabric member, and particularly the foamed polymer layer, has been found to increase the ability of the fluidization air to impart this charge, while the overall structural configuration of the belt 14 has been seen to yield an oval turbulence pattern within the mix due to the belt weave, thereby creating an alternating field of twisting the dipoles in one direction and causing an energy loss, all of which results in hysteresis and retention of the metallic particles on the belt 14.

c. Riffle Member of Belt Assembly

A plurality of transversely extending riffle members 80 are positioned on top of fabric member 100, again in a manner somewhat resembling the earlier configuration described above. These are spaced apart with respect to the direction of motion of the belt, so as to form a plurality of collection zones 110 between them. However, these riffle members 80, rather than simply being the small diameter steel rods which were used in the earlier versions of the belt assembly, are constructed of several concentrically-disposed layers or members so as to provide several advantages over the previously known arrangements.

In the embodiment which is illustrated, each riffle member 80 comprises a central steel rod 112 which forms a structural core member about which the remainder of the riffle member is built. A first insulating sleeve 114 is positioned concentrically about the steel core: primarily, this serves as a first electrical insulator for insulating the inner Steel core from the outer surface of the riffle member so as to prevent dissipation of the electrostatic charge on the belt, and secondly this serves as a spacer for supporting the surrounding portions of the riffle member and increasing the diameter thereof; polyurethane tubing has been found to be an eminently suitable material for constructing this sleeve.

The next concentric member is primarily structural in nature, and, in the embodiment illustrated, is made up of inner and outer metallic (e.g., steel) tubes 116 and 118 disposed in concentric relationship; these tubes serve mainly to impart additional structural rigidity to the riffle member as this extends transversely across the belt, so much so that it has been found to be possible to slim,hate the central support structure which was incorporated in belt arrangements of the earlier machines described above. The use of two concentric tubes rather than one provides maximum additional strength at minimal expense in terms of weight, and these again serve again to increase the diameter of the riffle member. Inexpensive steel conduit has been found to be a highly suitable material for fabricating these inner and outer tubes.

The final concentric layer making up each of the riffle members is provided by an outer insulating sleeve 120, such as polyurethane tubing again, this preferably being ultraviolet treated so as to enhance the durability of the structure in a field environment. The main purpose of this outer polyurethane tube is to provide the primary insulator for preventing dissipation of the electrostatic charge on belt 14, being that this outer sleeve forms the contact surface between the riffle and the fabric member of the belt. It will thus be observed that the inner and outer polyurethane sleeves provide two layers of insulation between the outer surface of the riffle member and its inner core. Hence, even though the inner steel core 112 may be attached directly to the metallic drive chain 54 (as will be described below), so that this would otherwise form a conductive path by which the charge might be dissipated, the two separate insulating layers provide an effective shield against such dissipation.

Figure 5:
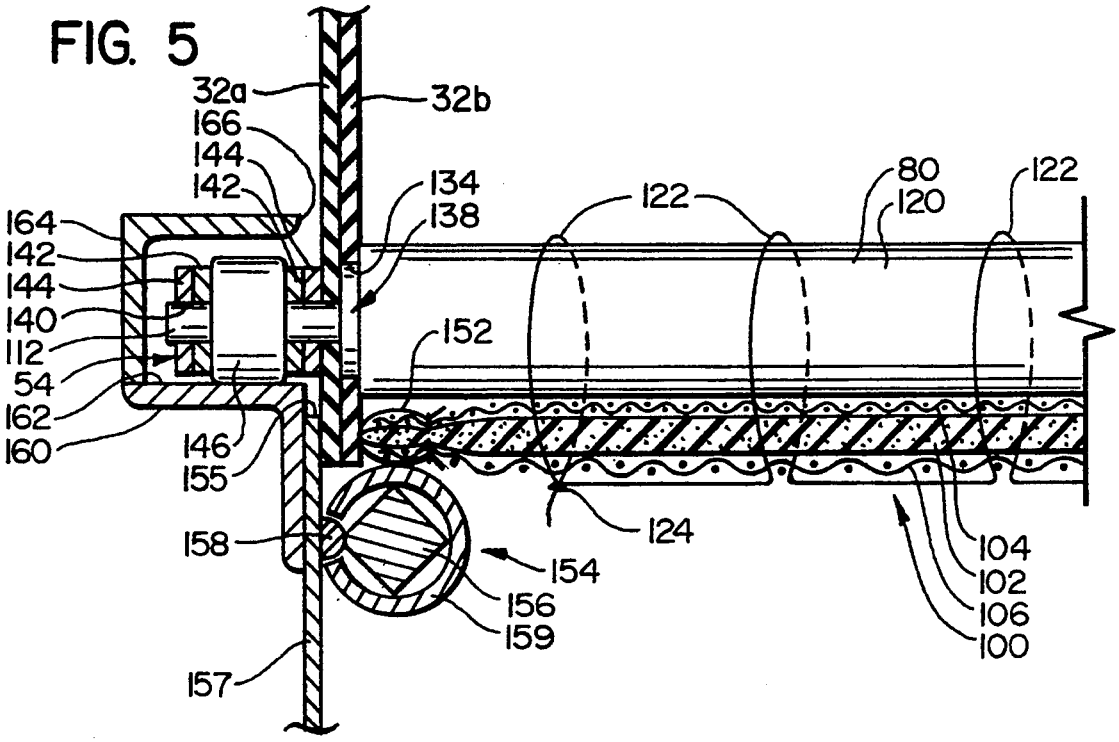
FIG. 5 is an enlarged, fragmentary sectional view taken along line 5—5 of FIG. 1, showing the manner in which the edge of the belt assembly is mated to the top of the plenum chamber, and also the manner in which a simplified seal is formed therewith.

So as to further enhance the resistance of the belt structure to dissipation of the electrostatic charge, the coiled steel webbing which was formerly employed for attaching the riffle members to the fabric member of the belt has been eliminated in the present invention, and this has been replaced by a series of non-conducting cord loops which are spaced along the length of each riffle member. Preferably, these loops are made of short lengths of polyester cord 122, and, as is shown in FIG. 5, these extend over the tops of each of the cylindrical riffle member 80, and then through the underlying fabric member 100, with the ends of these cords being secured together by knots 124 or other suitable securing means. It will be appreciated that the riffle members 80 are thus securely attached to the fabric member of the belt.

In an exemplary construction as described above, the riffle members 80 may each have an external diameter of approximately 1¼ inch, these being mounted to the fabric member of the belt on approximately 4 inch centers, thus forming collection zones 110 which are approximately 2¾ inches wide between adjacent riffle members. As was noted above, a significant advantage which is achieved by this construction is the formation of significantly enlarged "pockets" 82 where the downstream edges of the collection zones meet the upstream edges of the riffle members, this being best shown in FIG. 6. As previously discussed, this collection "pocket" is formed on the underside of the curved surface of the riffle, which, by virtue of the curved profile and underlying fabric, provides a closed collection space for trapping the retained material. The increased diameter of the riffles constructed in accordance with the present invention provides collection areas which are roughly trebled in size relative to those which were provided by the prior construction described above; furthermore, the increased radius of the riffle members yields a corresponding increase in the depth of the collection "pockets", so that these much more effectively retain the metallic particles once they have been collected therein.

Figure 6:
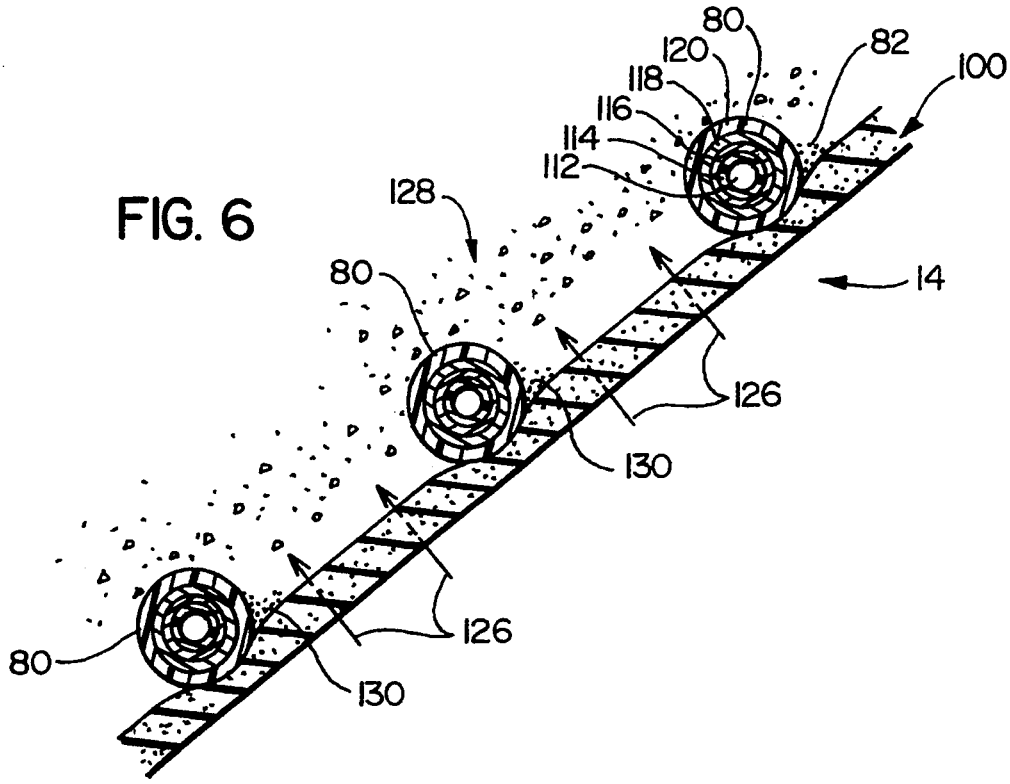
FIG. 6 is an enlarged, fragmentary sectional view of the belt assembly in operation, showing the fluidization of the gravel charge thereon, and the accumulation of the metallic constituents in the collection areas which are formed where the riffle members meet the fabric member of the belt assembly.

FIG. 6 provides an illustration of how the fluidization air passes upwardly through the fabric member 100 of belt 14, in the direction indicated by arrows 126, so as to fluidize the charge of gravel 128 on the belt member, with the result that this moves down the upwardly inclined segment of the belt and the metallic constituents 130 are retained in these collection areas 82.

d. Edge Flights of Belt Assembly

Returning now to FIG. 4, this also shows the manner in which the riffle members are attached to the drive chain 54 so as to enable the drive system to engage the belt, as well as the arrangement of the edge flights which form the upstanding border of the belt assembly. As is shown, each of these flights 32 comprises a generally rectangular plate-like structure, this being made of a suitable resilient material, such as fiberglass-reinforced vinyl or rubber, this being selected so as to be sufficiently rigid to control and guide the gravel charge as this flows along the belt assembly, yet also so as to be sufficiently flexible to minimize the previously-described safety hazards by flexing laterally in the event that a person's hand or other body part is accidentally caught between adjacent flights.

Bores are formed through the two lower corners of each of the flights 32: the first of these bores, as indicated by reference numeral 134, is generally circular and has a diameter which corresponds to that of the outer steel sleeve 118 of the riffle member; the second bore 136 is generally oblong in configuration, and has a width which corresponds generally to the diameter of the inner steel core 112 of the riffle member. Thus, as can be seen in FIG. 4, each flight 32 fits over the ends of two adjacent riffle members. At one corner (normally the trailing) the large circular bore 134 slips over the outer steel sleeve of the riffle member and abuts the outer end of the polyurethane sleeve 120, this being spaced inwardly from the ends of the inner steel and polyurethane sleeves of the riffle member so as to form what amounts to a radially-extending shoulder about a central boss, as indicated generally at 138 in FIG. 4. The distance by which the outer polyurethane sleeve is cut back preferably corresponds to the thickness of the flights, so that when the boss at the end of the riffle member is slipped through the bore 134, the outer ends of the inner steel and polyurethane sleeves line up flush with the outer face of the flight when the shoulder formed by the outer polyurethane tube abuts the inner face of the flight, and the inner steel core 112 extends outwardly beyond this. Thus, when the next flight 32 is slipped over the protruding end of the inner steel rod of the riffle member, so that this passes through oblong bore 136, the inner face of that flight will fit tight against the outer face of the first flight where these overlap, forming a seal between the two adjacent flights to prevent the escape of material from the sides of the belt.

The elongated oval bore 136 serves to permit relative movement of adjacent riffle members 80 when these pass over the sprocket assemblies at the end of the upwardly inclined segment of the belt. In other words, the slot permits the central rod 112 to work back and forth therein as the belt rounds the corners at sprockets 52 and 58, thus permitting the distance between adjacent riffle members to be lengthened and foreshortened as necessary without requiring the plate-like edge flights 32 to compress or flex.

As is shown in FIG. 4, the core rods 112 of the riffle members 80 protrude through the holes in the edge flights 32 and extend laterally therefrom. Each of these protruding ends is received in a corresponding bore 140 in drive chain 54. These bores 140 pass through the pairs of inner and outer side plates 142, 144, and the central roller 146, which make up each link of the drive chain. The outer ends of the rods 112 protrude laterally beyond the outer edge of the drive chain, and these are secured thereto by any suitable means, such as by spot welding the ends of the rods to the outermost side plates. Preferably, the side plates and rollers of the drive chain 54 are sized so that at least one other roller member **146*a* is positioned between each of those which is mounted to a rod 112, this being connected to the side plates of the drive chain by a pivot pin 148** so as to permit the links of the drive chain to flex where this extends around bends in the system, as at the drive sprockets and elsewhere. In an exemplary construction, the links in the drive chain may each be about two inches in length, with the rollers being about 1⅛ inch in diameter and ⅝ inch in width.

e. Edge Seal Structure

Another feature of the present invention is that this is provided with means for forming a seal between the edges of the belt assembly and the air plenum chamber without developing excessive friction and drag between these parts. FIG. 5 shows the manner in which this seal is achieved.

The edge of the fabric member lee of the belt assembly is provided with an abrasion resistant sealing strip 152. This may be formed by folding a strip of resilient, yet durable and abrasion-resistant fabric—such as a polyester fabric having a smooth, continuous vinyl coating—over the edges of the foam and upper and lower fabric layers of the fabric member, and then stitching through this to retain the edge strip in place. The lower surface of edge strip 152 slidingly abuts the upper surface of a seal member 154, which is mounted within the upstanding rim 155 of plenum chamber 16 and extends longitudinally along this. In the embodiment illustrated, this seal member 154 is formed by a steel bar or rod 156 which is welded along the inner surface 157 of the rim of the plenum chamber at bead 158. The lower surface of the edge strip rides along a low-friction surface formed on the seal member by a low-friction sleeve 159 which is fitted around rod 156. PVC tubing has been found to be an eminently suitable material for forming this sleeve 159, this being split longitudinally and then slipped over the support rod of the seal member; in this regard, it has been found advantageous to use square cross-section bar stock to form rod 156, since the corners on this engage the inner surface of the PVC tube to keep this from twisting and working on the rod, and also, one edge of the stock forms a convenient attachment portion for mating with bead 158. For example, it has been found suitable in some embodiments of the present to form the core of ⅜ inch square soft iron rod, with ½ inch PVC water pipe then being split and fitted over this.

The upper surface of the edge strip on the fabric member fits against the undersides of the ends of the riffle members 80, the fabric member of the belt assembly being secured to these members by the cord loops described above. These components are configured so that when the belt assembly is installed over the plenum chamber 16, there are normally (i.e., in the absence of a load) relatively loose tolerances between the edge strip of the fabric member and the sealing member inside the mouth of the box, thus virtually eliminating friction or drag between the belt assembly and the sealing member under such conditions; for example, there may be a vertical gap or range of movement on the order of 1/16 inch between these members in the absence of a load. Then, when a load of gravel is charged onto the upper surface of the belt assembly, the weight of this depresses the whole of the assembly downwardly slightly, and especially the portions of the edge of the fabric belt member which are between the riffle members. This causes the edge strip of the fabric member to move downwardly into sliding engagement with the seal member 154, as is shown in FIG. 5, substantially along the entire length of each edge of the mouth of the plenum chamber. This sliding engagement of the vinyl edge strip and the PVC pipe forms a highly effective seal for preventing the escape of air along the edges of the plenum chamber, without generating excessive friction and drag between these two components. Furthermore, this arrangement eliminates the need to "preload", compress, or otherwise force sealing members into engagement with one another in these areas to form the necessary seal. The effectiveness of the seal is enhanced by the close fit of the outer surface of the downwardly extending edges of the flights against the inner surface 157 of the lip of the plenum chamber, and the relatively close fit of the edge strip of the fabric member against the inner surfaces of these portions of the flights.

As a further refinement, the transverse edges of the upper mouth of the plenum chamber are preferably provided with crossmembers or lips (not shown) which extend across the fabric member of the belt assembly and fit closely beneath the lower surface of the fabric member, so that this rides over the lips at the ends of the inclined run of belt. These crossmembers are provided with another low-friction sleeve which, in this case, engages the bottom of the fabric member of the belt assembly so as to form a transversely extending seal across this; it has been found particularly effective to form this seal member (not shown) from Teflon TM tubing which is split in two longitudinally and fastened, one-half each, to the two crossmembers at the end of the inclined run of the belt, with the Teflon TM tubing being secured to these members by both fasteners (e.g., bolts) and adhesives (e.g., epoxy) to provide a durable installation which, amongst other things, resists the contraction and expansion of these components which occurs in a field environment due to climatic variations.

The upper rim 155 of the plenum chamber also supports an outwardly extending angle bracket 160, the upper, generally horizontal surface 162 of which forms a track for supporting the roller members 146 of the drive chain 154 as this is pulled across the top of the plenum by the drive system. In this regard, it will be observed that the diameters of the roller members 146 of the chain are slightly greater than the widths of the side plates 142, 144 to which they are mounted, so that the rollers rollingly engage the track 162 without the side plates rubbing thereon. This also shows the manner in which the core rod 112 of each riffle member bypasses through the roller member and side plates of the drive chain, so that longitudinal forces applied to the drive chain by the drive system 18 are transmitted thereby to the riffle members, and from the riffle members to the fabric member and edge flights of the belt assembly, so that the assembly moves together over the frame of the machine.

A second angle bracket 164 extends upwardly from the outer edge of the first angle bracket 160, and then inwardly over the drive chain so that its inner lip 166 is positioned relatively closely adjacent the outer surfaces of the edge flights of the belt assembly. This bracket 164 thus forms a cover or "cap" over the top of the drive chain, stabilizing this and preventing it from Jumping away from the top of the plenum chamber during operation, as, for example, when charges of gravel are dumped onto the belt assembly.

FIG. 5 also provides a further illustration of the relationship between the ends of the riffle members 80 and the edge flights **32*a*, 32*b*. In particular, this shows the manner in which the extending boss portion 138 at the end of the riffle member is sized to fit within the bore 134 so that the first flight 32*b* slips over this and closely abuts the outer polyurethane tube 120 at its inner surface. AS was noted above, the length of boss 138 corresponds to the thickness of the flight, so that when the central rod 112 of the riffle member is slipped through the smaller bore 136 in the next adjoining flight 32*a*, this second flight fits flat against the first where these two are overlapped. The side plates of the drive chain 54, in turn, abut the outer surface of the second flight 32*a* so as to press the overlapped portions of the two flights together, ensuring that a fairly tight seal is maintained between these so as to prevent the escape of material along the edges of the belt assembly. Also, it is desirable that the flights be overlapped as shown in FIG. 1**, so that the outwardly disposed edges of the flights are positioned toward the direction of travel of the belt and the inwardly disposed edges are positioned rearwardly, so as to obviate any tendency of material to accumulate against the edges of the flights and work out through the gaps between them.

f. Removal of Excess Dust From Belt

The foregoing discussion has centered largely on the structure of the belt assembly 14 and its associated fittings. Another significant feature of the present invention relates to the need to remove excess dust and other accumulations of undesirable (usually non-metallic) particulate material from the belt assembly prior to collection of the valuable metallic constituent.

Figure 7:
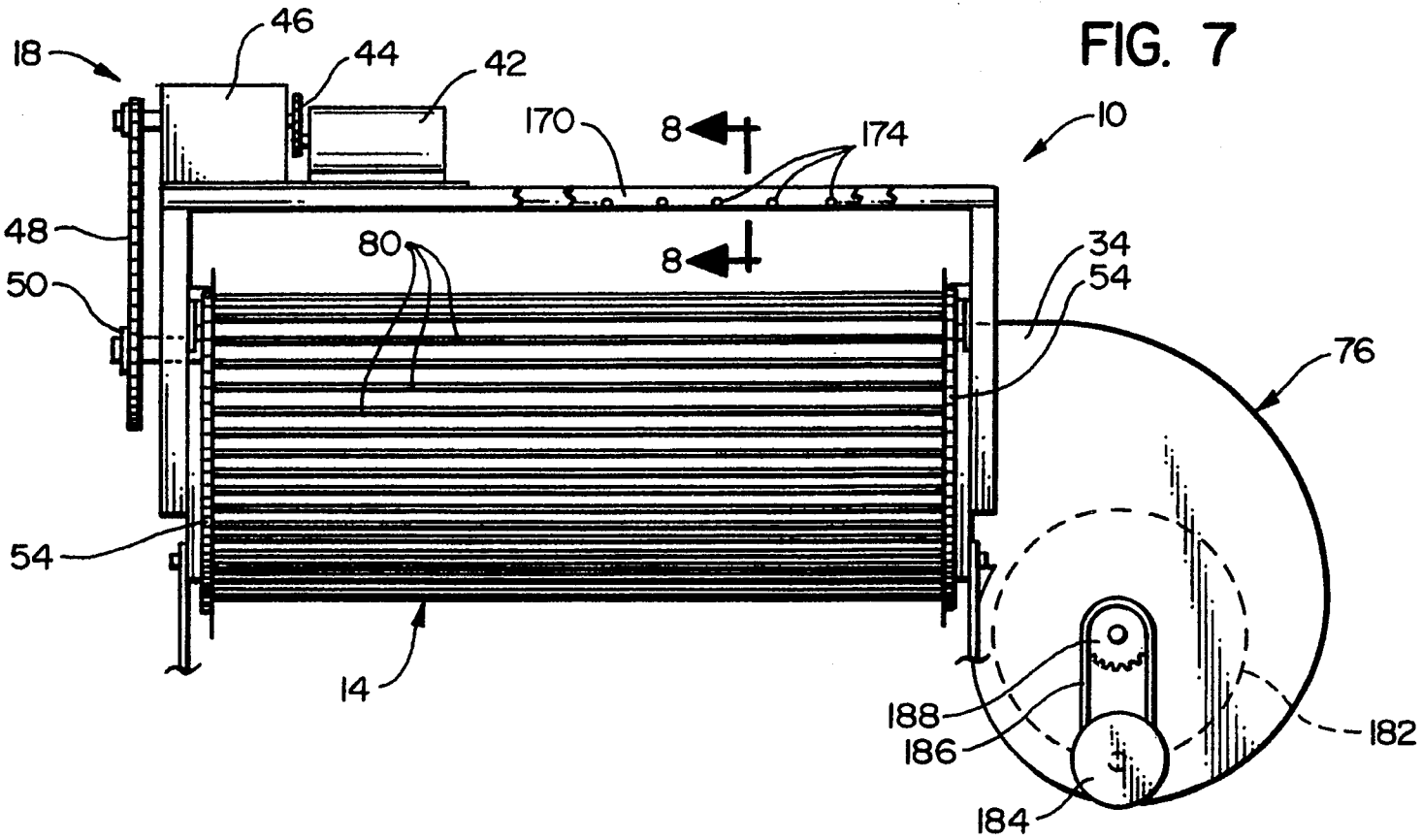
FIG. 7 is an end elevational view of the machine of FIG. 1, showing the arrangement of the blower assembly for charging the plenum chamber, and a crossbar which forms a manifold in communication with the plenum chamber, this being positioned above the upper surface of the belt and having a series of air discharge ports for directing a blast of air against the surface of the belt so as to dislodge accumulations of dust therefor.
Figure 8:
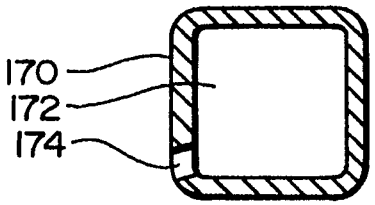
FIG. 8 is a cross section taken through the crossbar shown in FIG. 7, this being taken along line 8—8 of that Figure.

As is perhaps best shown in FIGS. 7 and 8, this is achieved in accordance with the present invention by means of an assembly which directs a flow of air towards the upper surface of the belt near the upper end of its inclined segment, so as to dislodge and remove the accumulations of unwanted particulate matter. In particular, FIG. 7 shows a hollow bar member or manifold 170 which extends transversely across the belt member 14 near the upper end of the inclined segment 20. As is also shown in FIG. 8, this is provided with a hollow interior 172 (this having a square cross section in the embodiment illustrated) which communicates with a series of orifices or nozzles 174 which extend across the width of the belt. As is best shown in FIG. 4, these nozzles 174 are angled to direct the blast of air which exits through them toward the underlying belt, with this angle being selected relative to the velocity and volume of the air flow to provide a blast which is sufficient to dislodge the unwanted particulate matter, but without removing the valuable metallic constituent from the belt.

Manifold 170 is supported above the belt by a pair of stanchions 176, 178, these being mounted to the upper frame 24 of the machine. As is shown in FIG. 3, at least one of these stanchions (stanchion 176 in the embodiment illustrated) has a hollow construction and is in fluid communication with the interior of air plenum chamber 16 through a port 180. As was noted above, the interior of plenum chamber 16 is charged with compressed air; thus, air under pressure enters the stanchion from plenum 16, and travels through it to the interior of the hollow cross bar 170, which it enters through a second port 182. The air then exits the bar through the nozzles in the manner previously described, blowing the unwanted particulate material away from the surface of belt 14 prior to the collection of the metallic constituents. Preferably, this dislodged dust is collected in a vacuum hood or chamber, or like structure (not shown), so that this can be collected and disposed of with minimum impact to the surrounding environment.

g. Build-Up of Electrostatic Charge on Airflow

As was noted above, the plenum chamber 16 of machine 10 is charged with air; in the embodiment which is illustrated, this is done by means of fan assembly 76, which comprises (as is shown in FIG. 7) a blower 182 Which is driven off of a motor 184 by a belt 186 and pulley 188, with the discharge from this being directed into the plenum chamber 16 by the relatively large duct 34, so as to pressurize the chamber with the fluidization air. As the air enters the plenum chamber, it is "broken up" and directed therein by the baffle plates 38 which were described with reference to FIG. 1. Accordingly, it will be understood that the air flow comes into contact with several interior components of this assembly during the course of its flow through the machine, including, for example, the vanes of the blower, the interior of duct work 34, the baffle plates 38, the interior of plenum chamber 16, and so forth. It is a feature of the present invention that one or more of these components is coated with a suitable insulating material, such as a polyurethane or rubber coating. The function of this coating is two-fold: firstly, the coating serves to enhance the buildup of an electrostatic charge (preferably positive) on the air as this flows through the assembly, due to the friction which occurs as the air comes into contact with and passes through these components, thus complementing the buildup of the electrostatic charge on the fabric member of the belt assembly through which the air subsequently passes; secondly, the insulating qualities of the coating help prevent the dissipation of the electrostatic charge as this passes through these assemblies enroute to the belt. This feature has been found to significantly enhance the ability of the machine to build up the desired electrostatic charge on the inclined segment of the belt, to the extent that, in conjunction with the belt assembly constructed in accordance with the present invention, it has been found possible to dispense with the need for any sort of auxiliary electrostatic charge generator under the vast majority of operating conditions.

As noted above, the system described herein may be used particularly for the separation of gold or silver from gravel particulate. It has been found that the apparatus incorporating the present invention requires only a relatively small amount of electrostatic charge to create an effective influence with respect to fine particle-sized gold. The charge is created by breaking up the air flow and creating turbulence in the manner described above. First, the air flow is broken up as it passes over the polyurethane, rubber, or other static-building material coating of the blower assembly and plenum chamber, so that this creates a relatively large electrostatic charge on air within the air box. This heavily charged air, in turn, charges the filter belt, by passing through this and imparting its charge to the belt assembly, and also due to the turbulence which is thus created, as was also described above. For separation of gold, it has been found effective to adjust the continuous flow of air through the belt to build a constant charge of roughly 20,000 to 25,000 volts. A triboelectric positive charge is developed on the particles of gold, which attracts them to the moving belt assembly for concentration and subsequent recovery, as described above.

While the invention has now been described with reference to its preferred embodiments, those skilled in the art will appreciate that various substitutions, changes, modifications, and omissions may be made without departing from the spirit thereof. Accordingly, it is intended that the scope of the present invention be limited solely by that of the claims granted herein.

What is claimed:

1. A belt assembly for use in a dry placer mining machine which concentrates metallic constituents from a gravel mix by fluidizing said mix with a gas and separating said metallic constituents from said mix by moving said fluidized mix over said belt assembly and applying an electrostatic charge to said belt assembly, said belt assembly comprising:

a composite fabric belt member, said fabric belt member being configured so that said electrostatic charge is established on said belt member as said fluidizing gas passes therethrough, said fabric belt member being constructed substantially entirely of nonconductive materials so as to minimize dissipation of said electrostatic charge; and a plurality of riffle members attached to and extending transversely across said fabric belt member in spaced, generally parallel relationships so as to define a series of collection zones, each said riffle member comprising:

an electrical insulator portion interposed in a conductive path through said riffle member, from said belt member to a conductive structure which is mounted to said riffle member, so as to prevent dissipation of said electrostatic charge due to said charge being conducted away from said fabric belt member to said conductive structure through said riffle member.

2. The belt assembly of claim 1, wherein said composite fabric belt member comprises:

an upper fabric layer of relatively finely woven cloth, said cloth being nonconductive in character and resistant to absorption of moisture so as to retain said nonconductive character under damp operating conditions;

a middle layer of air pervious foam, said foam being nonconductive in character and having pores sized generally larger than openings in said finely woven cloth; and a lower layer of relatively coarsely woven cloth, said coarsely woven cloth being nonconductive in character and having openings sized generally larger then said pores of said foam;

whereby said composite-fabric belt member presents a gradient from bottom to top, corresponding to the direction in which said fluidization gas passes through said belt member.

3. The belt assembly of claim 2, wherein said relatively finely woven cloth of said upper layer is 100% polyester cloth.

4. The belt assembly of claim 3, wherein said 100% polyester cloth has a broadcloth weave of about 200 threads per inch.

5. The belt assembly of claim 2, wherein said relatively coarsely woven cloth of said lower layer is relatively more resistant to stretching than said middle and upper layers, so that said lower layer forms a backing which imparts strength to said belt assembly during operation.

6. The belt assembly of claim 5, ,wherein said relatively coarsely woven cloth is a vinyl coated polyester mesh.

7. The belt assembly of claim 2, wherein said air pervious foam of said middle layer is a reticulated foam in which said pores are of substantially uniform size so that said flow of said fluidization gas is evenly distributed through said fabric belt member by said layer of foam.

8. The belt assembly of claim 7, wherein said reticulated foam is reticulated polyester foam.

9. The belt assembly of claim 1, wherein said electrical insulator portion of each said riffle member comprises a sleeve of electrically insulating material surrounding said riffle member.

10. The belt assembly of claim 9, wherein said insulating material is polyurethane tubing.

11. The belt assembly of claim 1, wherein each said riffle member comprises:

a metallic rod forming a core member of said riffle member; and an outer sleeve member of electrically insulating material surrounding said core member so as to prevent dissipation of said electrostatic charge due to said charge being conducted away from said fabric member through said metallic rod.

12. The belt assembly of claim 11, wherein each said riffle member further comprises:

a metallic sleeve member positioned concentrically intermediate said core member and said outer sleeve member for providing said riffle member with both additional diameter and strength against bending forces; and an inner sleeve member of electrically insulating material positioned concentrically intermediate said metallic sleeve and said core member so as to provide an additional electrically insulating layer between said metallic sleeve member and said metallic rod of said core member.

13. The belt assembly of claim 12, wherein said metallic sleeve member comprises first and second metallic tubes disposed concentrically with respect to one another.

14. The belt assembly of claim 13, wherein said riffle member has an external diameter of about 1.25 inches, so that a relatively large collection pocket is formed for retaining said metallic constituent at an edge of said collection zone where said riffle member abuts said fabric belt member of said assembly.

15. The belt assembly of claim 14, wherein said riffle members are spaced along said belt member at about 4 inch centers.

16. The belt assembly of claim 12, wherein outer ends of said metallic rods which form said core members of said riffle members extend beyond an edge portion of said fabric belt member, and said belt assembly further comprises a drive chain which is attached to said outer ends of said rods along said edge portion of said belt member, said drive chain being configured to be engaged by drive means configured for moving said belt assembly along a closed path about said machine.

17. The belt assembly of claim 16, wherein said drive means comprises a sprocket system for engaging said drive chain.

18. The belt assembly of claim 17, further comprising:

a plurality of flights positioned intermediate said edge portion of said belt member and said drive chain so as to form a segmented, upstanding border along said edge portion of said belt member, each said flight having first and second cooperating bores configured to receive adjacent said outer ends of said rods, each said flight being formed of a flexible, resilient material so as to avoid posing a hazard to personnel where gaps between adjacent said flights open and close during operation of said machine.

19. The belt assembly of claim 18, wherein at least one said cooperative bore in each said flight is elongated so as to permit a predetermined amount of movement of said adjacent riffle members toward and away from one another during said operation without requiring deformation of said flight.

20. The belt assembly of claim 18, wherein said flights are configured so that edges of adjacent said resilient flights overlap when mounted on said rod ends, so that said overlapped flights form a seal for preventing the escape of said fluidized gravel mix which is moved over said belt assembly.

21. The belt assembly of claim 20, wherein an end portion of at least one concentrically outer said sleeve member is recessed by a selected distance from end portions of concentrically inner said sleeve members so as to form a shoulder portion which extends radially about a boss portion which is formed by said inner sleeve members, said selected distance being substantially equal to a thickness of said material of said flights and said first cooperative bore in each said flight being sized to receive said boss portion at said end of said riffle member so that said shoulder portion abuts an inner surface of a first said flight and said end of said concentrically inner sleeve members lies substantially flush with an outer surface of said first flight, with said core member formed by said metallic rod extending outwardly therefrom, and said second cooperative bore in each said flight being sized to receive said core member so that an inner surface of a second said flight overlaps and fits flat against said outer surface of said first flight, said overlapped outer and inner surfaces of said flights being held in sealing abutment between said shoulder portion of said riffle member which abuts said inner surface of said first flight and said drive chain, said drive chain being mounted on said outer ends of said core members of said riffle members so as to abut said outer surface of said second flight.

22. The belt assembly of claim 21, wherein said concentrically outer sleeve member which is recessed to form said shoulder portion on said end of said riffle member is said outer sleeve member of insulating material.

23. The belt assembly of claim 21, wherein said elongated bore is said second bore in each said flight.

24. The belt assembly of claim 11, wherein said riffle members are attached to said fabric belt member by loops of nonconductive cord which extend about said outer insulating sleeve members of said riffle members and through said fabric belt member.

25. The belt assembly of claim 24, wherein said nonconductive cord comprises polyester cord.

26. A dry placer mining machine for concentrating metallic constituents from a gravel mix by fluidizing said mix with a gas and separating said metallic constituents from said mix by moving said fluidized mix over a belt and applying an electrostatic charge thereto, said machine comprising:

a frame for supporting and guiding an endless separation belt along a closed path having an upwardly inclined segment for receiving a gravel mix containing a low concentration of metallic constituents;

an endless separation belt assembly, said belt assembly comprising:

a composite fabric belt member, said fabric belt member being configured so that said electrostatic charge is established on said belt as a fluidizing gas passes therethrough, said fabric belt member being constructed substantially entirely of nonconductive materials so as to minimize dissipation of said electrostatic charge; and a plurality of riffle members extending transversely across said fabric belt member in spaced, generally parallel relationships so as to define a series of collection zones, each said riffle member being attached to said fabric belt member and comprising insulating means for preventing dissipation of said electrostatic charge due to said charge being conducted away from said fabric belt member through said riffle members;

fluidizing means for passing said fluidizing gas upwardly through said fabric belt member of said separation belt assembly substantially uniformly along and about said upwardly inclined segment so as to fluidize said gravel mix and establish said electrostatic charge on said belt assembly; and drive means for driving said belt assembly along said closed path so that said fluidized gravel mix moves over said belt assembly and said electrostatic charge effectuates a substantial separation of said metallic constituents from said gravel mix and retention of said metallic constituents proximate said riffle members, whereby said metallic constituents are concentrated for collection.

27. The mining machine of claim 26, further comprising means for removing accumulations of non-metallic particulates from said belt assembly prior to collection of said concentrated metallic constituents.

28. The mining machine of claim 27, wherein said means for removing accumulations of non-metallic constituents from said belt assembly comprises:

nozzle means for directing a flow of compressed gas towards said belt proximate an upper end of said inclined segment so as to dislodge said accumulations from said belt assembly; and means for supplying said compressed gas to said nozzle means.

29. The mining machine of claim 28, wherein said nozzle means comprises a plurality of nozzles spaced across the width of said belt assembly proximate said upper end of said inclined segment of said belt assembly.

30. The mining machine of claim 29, wherein said plurality of nozzles comprises:

a manifold tube extending across said width of said belt assembly; and a plurality of nozzle orifices in fluid communication with said manifold tube and spaced apart along the length thereof across said width of said belt assembly.

31. The mining machine of claim 30, wherein said means for supplying said compressed gas to said plurality of nozzles comprises means for connecting said manifold tube in fluid communication with said means for passing said fluidizing gas through said separation belt assembly.

32. The mining machine of claim 26, wherein said means for passing said fluidizing gas through said separation belt assembly comprises, a plenum chamber having an open upper end positioned beneath said upwardly inclined segment of said belt assembly;

a blower for drawing air from the surrounding atmosphere and compressing said air;

ducting for directing said compressed air from said blower into said plenum chamber; and baffle plates for distributing and directing said compressed air within said plenum chamber so that said air flows evenly in said upward direction through said fabric belt member of said assembly.

33. The mining machine of claim 32, wherein interior portions of said means for passing fluidizing gas through said belt assembly which are subject to contact with said fluidizing gas are coated with an insulating material which is configured to build up an electrostatic charge on said gas which flows therethrough, so as to supplement said electrostatic charge which is established on said belt assembly as said gas passes through said fabric belt member thereof.

34. The mining machine of claim 33, wherein said insulating material comprises a polyester coating on said interior portions.

35. The mining machine of claim 33, wherein said insulating material comprises a rubber coating on said interior portions.

36. The mining machine of claim 34, wherein interior portions of said blower, ducting, baffle plates, and plenum chamber are all coated with said insulating material.

37. The mining machine of claim 26, wherein said means for passing said fluidizing gas through said separation belt assembly comprises:

a plenum chamber having an open upper end positioned beneath said upwardly inclined segment of said belt assembly, said opening having first and second longitudinal edges defined by first and second upper rim portions of said chamber which extend generally adjacent first and second edges of said inclined segment of said belt assembly.

38. The mining machine of claim 37, further comprising means for forming a substantially airtight seal between said upper rim portions of said chamber and said edges of said inclined segment of said belt assembly.

39. The mining machine of claim 38, wherein said means for forming said airtight seal comprises:

a longitudinally extending seal member mounted along an inner side of each said upper rim portion of said chamber; and a sealing strip mounted along each said edge of said belt assembly for slidingly abutting a said seal member so as to form said seal therewith as said belt assembly is driven over said opening of said chamber.

40. The mining machine of claim 39, wherein each said seal member comprises:

a support rod mounted along a said rim portion of said chamber; and a sleeve of low-friction material mounted around said sleeve.

41. The mining machine of claim 40, wherein each said sealing strip comprises, a strip of resilient, low-friction material folded over an edge of said fabric member of said belt assembly and mounted thereto.

42. The mining machine of claim 39, wherein said means for forming a seal is configured so that gaps exist intermediate said seal members and said sealing strips in the absence of a load on said inclined segment of said belt assembly so as to eliminate friction between said seal members and said sealing strips, and said inclined segment of said belt assembly is displaced downwardly in response to said gravel mix being charged onto an upper surface of said segment so as to eliminate said gaps, so that said airtight seal is formed between said seal members and said sealing strips.

* * * * *